US006641285B2

(12) United States Patent
Liu

(10) Patent No.: US 6,641,285 B2
(45) Date of Patent: Nov. 4, 2003

(54) MULTI-COLOR PIPE-TYPE LAMP

(76) Inventor: Chun-Ming Liu, No. 430, Kau Feng Road, Hsinchu City (TW)

( * ) Notice: Subject to any disclaimer, the term of this patent is extended or adjusted under 35 U.S.C. 154(b) by 0 days.

(21) Appl. No.: 10/082,277

(22) Filed: Feb. 26, 2002

(65) Prior Publication Data

US 2003/0161151 A1 Aug. 28, 2003

(51) Int. Cl.[7] ..... F21V 21/00

(52) U.S. Cl. ..... 362/249; 362/234; 362/223; 362/224; 362/242; 362/257; 362/293

(58) Field of Search ..... 362/249, 235, 362/237, 234, 223, 224, 242, 255, 257, 293

(56) References Cited

U.S. PATENT DOCUMENTS 3,544,785 A * 12/1970 Weibel ..... 362/224
4,020,335 A * 4/1977 Bisceglia ..... 362/224
4,521,838 A * 6/1985 Agabekov ..... 362/219
5,934,792 A * 8/1999 Camarota ..... 362/249
6,149,285 A * 11/2000 Cicarelli ..... 362/255

* cited by examiner

*Primary Examiner*—Sandra O'Shea
*Assistant Examiner*—Bertrand Zeade
(74) *Attorney, Agent, or Firm*—Rosenberg, Klein & Lee

(57) ABSTRACT

The present invention relates to a multi-color pipe-type lamp, which includes an inner tube and an outer transparent tube. The characteristic of this invention is to provide several middle tubes between the inner tube and the outer tube. The middle tube can be the same color of different color as desired and can be arranged in order or in disorder. As the lamp is lightened, it obtains multi-color due to the colorful middle tube that increases the decorative effect. Various decorations can be obtained according the invention.

4 Claims, 2 Drawing Sheets

MULTI-COLOR PIPE-TYPE LAMP

BACKGROUND OF THE INVENTION

A normal pipe-type lamp is always mono-color, which is the color of the bulb. In order to have colorful decorative effect of the pipe-type lamp, it is known to spray paint over an outer tube of the lamp. This method is inconvenient and the paint is usually not well-distributed. Moreover, the surface of the outer tube will be rough because of the sprayed paint, which is also possibly dropped.

Accordingly, the primary object of the invention is to provide a multi-color pipe-type lamp, which uses several middle color tubes to be assembled between the outer tube and inner tube for providing a well-utilized product. Now the features and advantages of the present invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
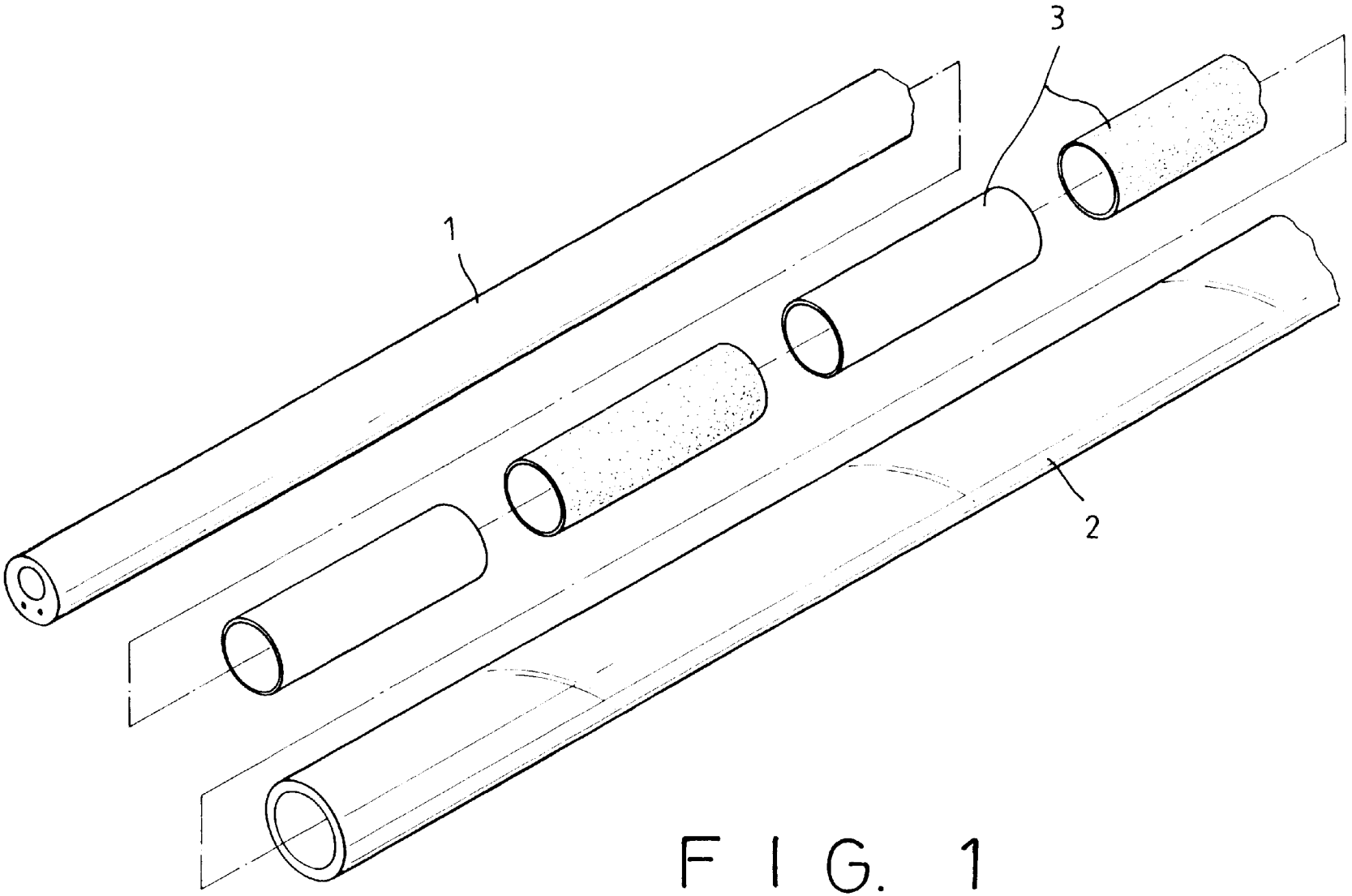
FIG. 1 is an exploded perspective view showing a multi-color pipe-type lamp according to the present invention.
Figure 2:
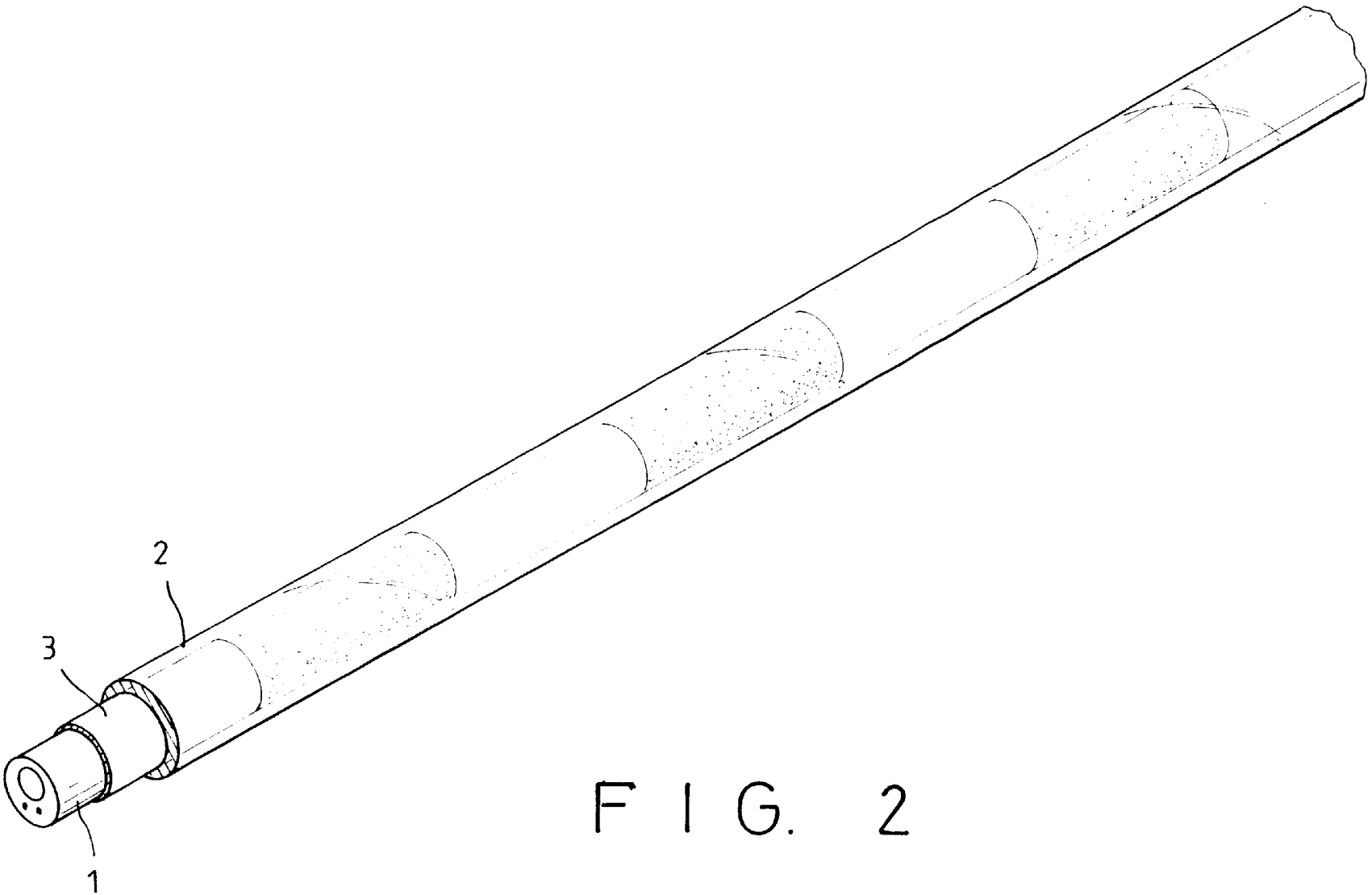
FIG. 2 is an assembled perspective view showing a multi-color pipe-type lamp according to the present invention.

Please refer to FIGS. 1 and 2, the present invention includes a pipe-type lamp having an inner tube (1) and an outer tube (2). The characteristic of the invention is to provide several middle tubes (3), which could be the same color or different color. In use, it is possible for a user to select the middle tube (3) having a desired color for positioning between the inner tube (I) and the transparent outer tube (2). Since the middle tube (3) is covered by the outer tube (2), it can be found that the lamp will have a smooth surface based on the outer tube (2). Dropped paint will not be happened in deed. Furthermore, it is possible to choose any different color of middle tube (2) in different arrangement to obtain a various decorative effect of the pipe-type lamp. The length of the middle tube (3) is also changeable for more variation.

Accordingly, the invented assembly of the present invention obviously obtains utility and improvement. It should be allowed for patent and is applied.

What is claimed is:

1. A variably colored pipe-type lamp comprising:

(a) a longitudinally extended inner lamp tube;

(b) a longitudinally extended transparent outer tube coaxially disposed about said inner lamp tube; and, (c) a plurality of colored middle tube segments slidably ensleeving said inner lamp tube to be disposed longitudinally therealong, said colored middle tube thereby being coaxially disposed in replaceable manner between said inner lamp and outer tubes, each of said colored middle tubes being less in longitudinal length than said inner lamp and outer tubes.

2. The variably colored pipe-type lamp as recited in claim 1 wherein said middle tube segments are uniform in longitudinal length.

3. The variably colored pipe-type lamp as recited in claim 1 wherein at least one of said middle tube segments is different in color from another of said middle tube segments.

4. The variably colored pipe-type lamp as recited in claim 5 wherein alternating ones of said middle tube segments longitudinally along said inner lamp tube are equivalent in color.

* * * * *